US006072971A

United States Patent [19]

Till et al.

[11] Patent Number: 6,072,971

[45] Date of Patent: Jun. 6, 2000

[54] PHOTO INJECTION ELECTROGRAPHIC IMAGING

[75] Inventors: Henry R. Till, East Rochester; P. Keith Watson, Rochester, both of N.Y.

[73] Assignee: Xerox Corporation, Stamford, Conn.

[21] Appl. No.: 09/217,034

[22] Filed: Dec. 21, 1998

[51] Int. Cl.[7] ..... B03G 15/06

[52] U.S. Cl. ..... 399/222; 399/233

[58] Field of Search ..... 399/222, 237, 399/239, 240, 307, 308, 368, 233; 430/30, 42, 117, 119, 126; 118/262

[56] References Cited

U.S. PATENT DOCUMENTS 4,456,367 6/1984 Szymanski et al. ..... 399/233

5,176,974 1/1993 Till et al. ..... 430/42

5,406,356 4/1995 Campbell et al. ..... 399/348 X

*Primary Examiner*—William Royer

*Assistant Examiner*—Hoan Tran

*Attorney, Agent, or Firm*—Reid K. Cunningham

[57] ABSTRACT

In an electrophotographic printing machine, a layer of insulating fluid containing micelles is positioned over a photoreceptor. The micelles are migrated onto the surface of the photoreceptor. The photoreceptor is exposed to inject charge carriers into the insulating fluid and selectively neutralize micelles to form an electrostatic latent image. The latent image is transferred to a dielectric surface and developed.

17 Claims, 5 Drawing Sheets

PHOTO INJECTION ELECTROGRAPHIC IMAGING

FIELD OF THE INVENTION

This invention relates to electrophotographic marking and more particularly, relates to electrostatic image formation.

BACKGROUND OF THE INVENTION

Electrophotographic marking is a well-known and commonly used method of copying or printing documents. Electrophotographic marking is performed by projecting a light image representation of a desired document onto a substantially uniformly charged photoreceptive member. In response to exposure to the light image representation, the photoreceptive member discharges so as to create an electrostatic latent image of the desired document. A development material having pigmented toner is then deposited onto the electrostatic latent image so as to form a toner image. The toner image is next transferred from the photoreceptor onto a substrate such as a sheet of paper. The transferred toner image, supported by the substrate, is fused into the substrate to form the completed printed document. Fusing of the toner image to the substrate is typically accomplished by a combination of heat and/or pressure. The surface of the photoreceptive member is then cleaned of residual developing material and recharged in preparation for production of a subsequent document.

The developing material can be formed of dry pigmented marking or toner particles attracted to the latent image areas to create a powder toner image on the photoreceptive or imaging member. Alternatively, a liquid developing material can be employed having charged pigmented marking particles immersed in a liquid carrier. The charge on the marking particles is created by a soluble ionic surfactant or charge director material dispersed or dissolved in a liquid carrier. The result is an electrochemical reaction that pruduces an exchange of ionic species between the marking particles and the micelles formed by the charge director. The liquid developing material is applied to the surface of the latent image-bearing member with the charged particles electrophoretically precipitated from the liquid developing material dispersion so as to migrate and be deposited on the image areas of the latent image. The migration and deposition of the toner particles forms the developed toner image.

In either dry powder toner development or liquid toner development arrangements, the image is developed onto the photoreceptive member. The toner image is subsequently transferred to the substrate for fusing. However, in certain circumstances, the toner image can incompletely transfer from the photoreceptive member to the substrate. The incomplete transfer can be due to the material or texture of the substrate. The incomplete transfer can also arise, for example, from low conformability of the photoreceptive member. Improved conformability can allow transfer of the toner image to relatively rough or different material substrates. Therefore in some circumstances, the toner image is first transferred to an intermediate transfer member having improved properties for the transfer of the toner image to the final substrate. Typically an improved property is increased conformability relative to a photoreceptor. However, this results in the necessity for an intermediate member and transfer of the toner image from the photoreceptive member to the intermediate member and then from the intermediate member to the substrate. Each transfer of the toner image has the potential for deterioration in quality of the toner image.

One form of electrophotographic printing employed to avoid these prior difficulties is ionographic printing where an electrostatic image is formed on an image-bearing member by an ion beam. The image bearing member is employed to avoid conformability of a photoreceptor but without additional transfers of the toner image. However, ionographic printing can have poor image quality, resulting from a phenomenon described as image blooming. In image blooming previously deposited ions can displace the subsequent ions directed to the charge retentive surface. This results in blooming or blurring of the image and therefore decreased image definition. This problem is particularly noticeable when printing characters and printing the edges of solid areas. Blooming defects may include picture elements being displaced by up to one or two pixel diameters. Image blooming can also result from poor charge retention on the image-bearing member. Furthermore, image blooming can result from charge migration in the electrostatic latent image formed on the image-bearing member. These problems are particularly prevalent for focused beam ion sources where the focused beam ion source is utilized for image-wise charging of a latent imagebearing member.

SUMMARY OF THE INVENTION

Briefly stated, an electrophotographic printing machine in accordance with the invention positions a layer of insulating fluid containing micelles (ionically charged entities) onto a photoreceptive member. An electric field is applied across the insulating fluid to migrate the micelles toward the interface of the photoreceptive member and the insulating fluid, resulting in an enhanced field across the photoconductor. The photoreceptive member is then exposed to a light image representation to discharge portions of the photoreceptive member. Due to the high fields generated between the micelles and the photoreceptive member, carrier ions are injected into the insulating fluid. The carrier ions neutralize the micelles located at the exposed portions of the photoreceptive member and therefore form an electrostatic latent image of the light image representation in the layer of insulating fluid.

The electrostatic latent image is then preferably transferred thickness relative to the photoreceptive member from the photoreceptive member to a dielectric material of greater diaelectric to thereby increase voltage contrast. The electrostatic latent image is then developed, preferably with liquid ink, to form a toner image. The toner image can then be transfused from the dielectric belt to a substrate to form a final document. The use of a dielectric material for transfuse allows for improved toner transfer due to the ability to construct a dielectric with high conformability. The dielectric can also be constructed with other additional properties, including heat resistance, that are difficult to achieve for typical photoreceptive materials.

DETAILED DESCRIPTION OF THE PREFERRED EMBODIMENTS

Figure 1:
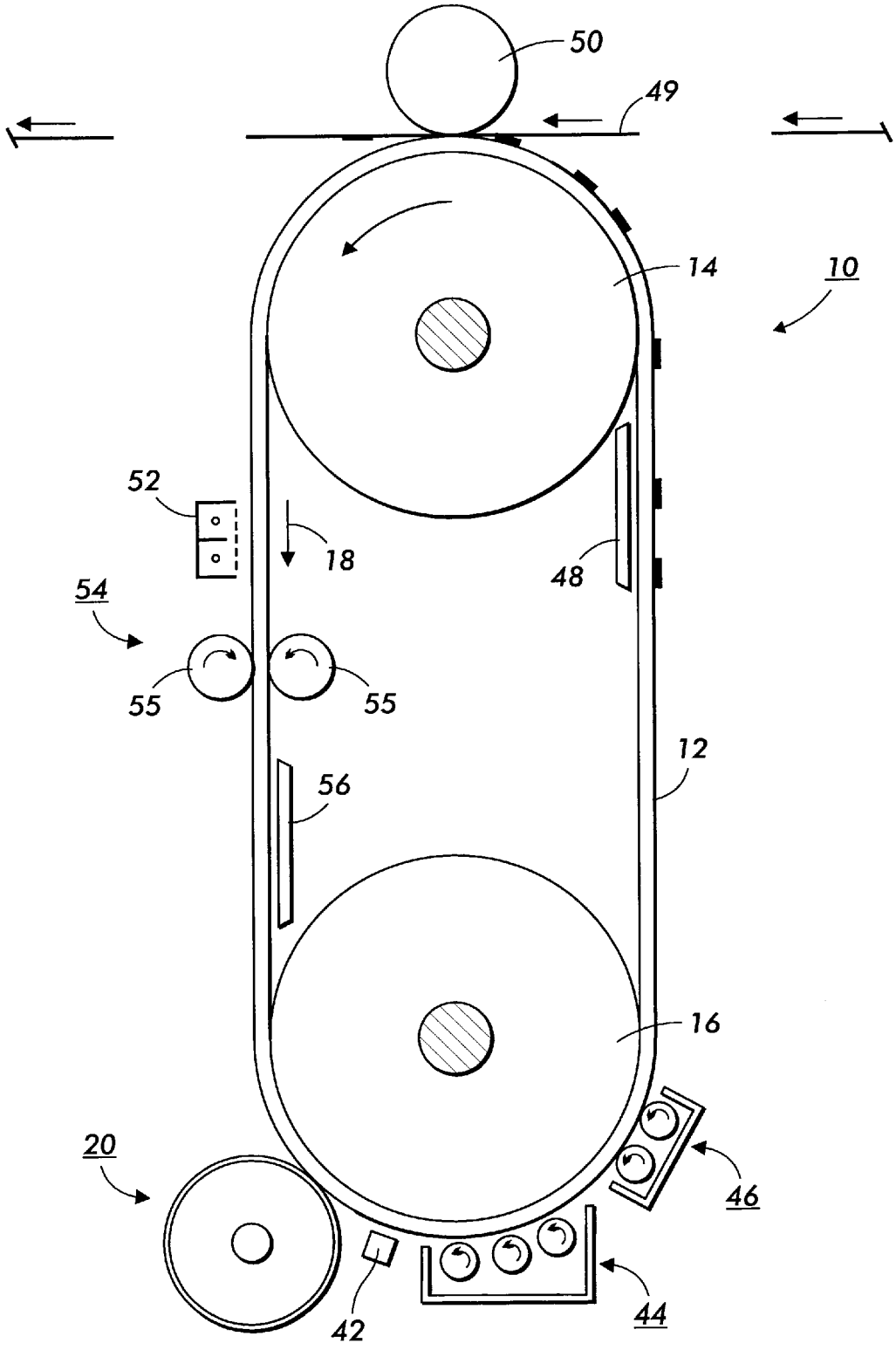
FIG. 1 is a schematic representation of an electrophotographic printing machine in accordance with the invention.
Figure 2:
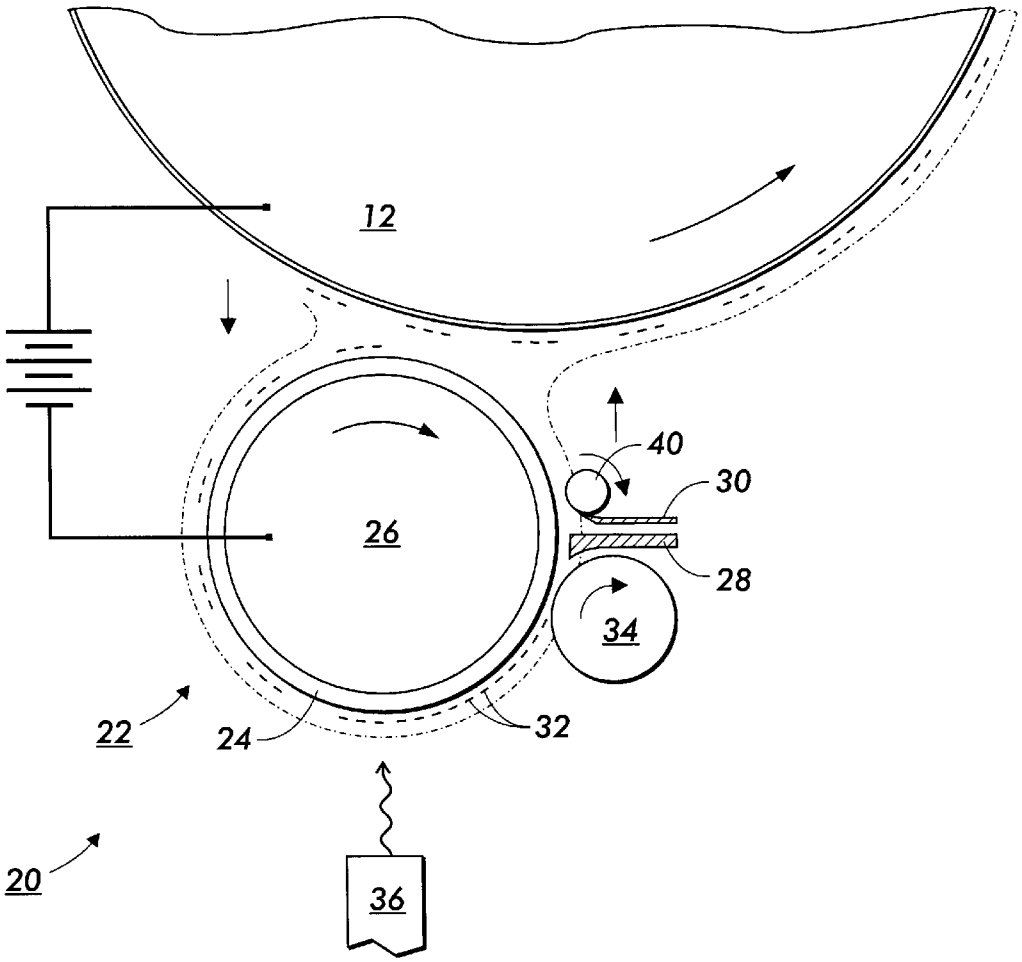
FIG. 2 is an enlarged detailed schematic view of the charging and exposure station of the electrophotographic printing machine of FIG. 1.

With reference to FIGS. 1 and 2, an electrophotographic printing machine 10 in accordance with the invention has a conformable dielectric belt 12. The dielectric belt 12 preferably has high conformability to allow for an improved and efficient simultaneous transfer and fusing (transfuse) of a toner image to a substrate. A heated first roller 14 and a second roller 16 move the dielectric belt 12 in a cyclical path. The first and second rollers 14 and 16 rotate to move the dielectric belt 12 in a process direction indicated by arrow 18. For purposes of discussion, a single section of the dielectric belt 12 is identified as the image area that receives the electrostatic latent image from the image station 20. The image area is that part of the dielectric belt 12 which receives the various processes by the various stations position around the dielectric belt 12. The dielectric belt 12 may have numerous image areas, however each image area is processed in the same way.

An image station 20 engages the dielectric belt 12 to position an electrostatic latent image onto the image area of the dielectric belt 12 (see FIG. 2). The image station 20 has a photoreceptive member 22. The photoreceptive member 22 is preferably formed of a drum having a thin photoreceptor layer 24 of photoreceptive material supported by a conducting support 26. Photoreceptors suitable for photo injection electrography include selenium and phthalocyanine. The photoreceptor layer 24 is preferably relatively thin, having a depth of 1–2 $\mu$.

Figure 3:
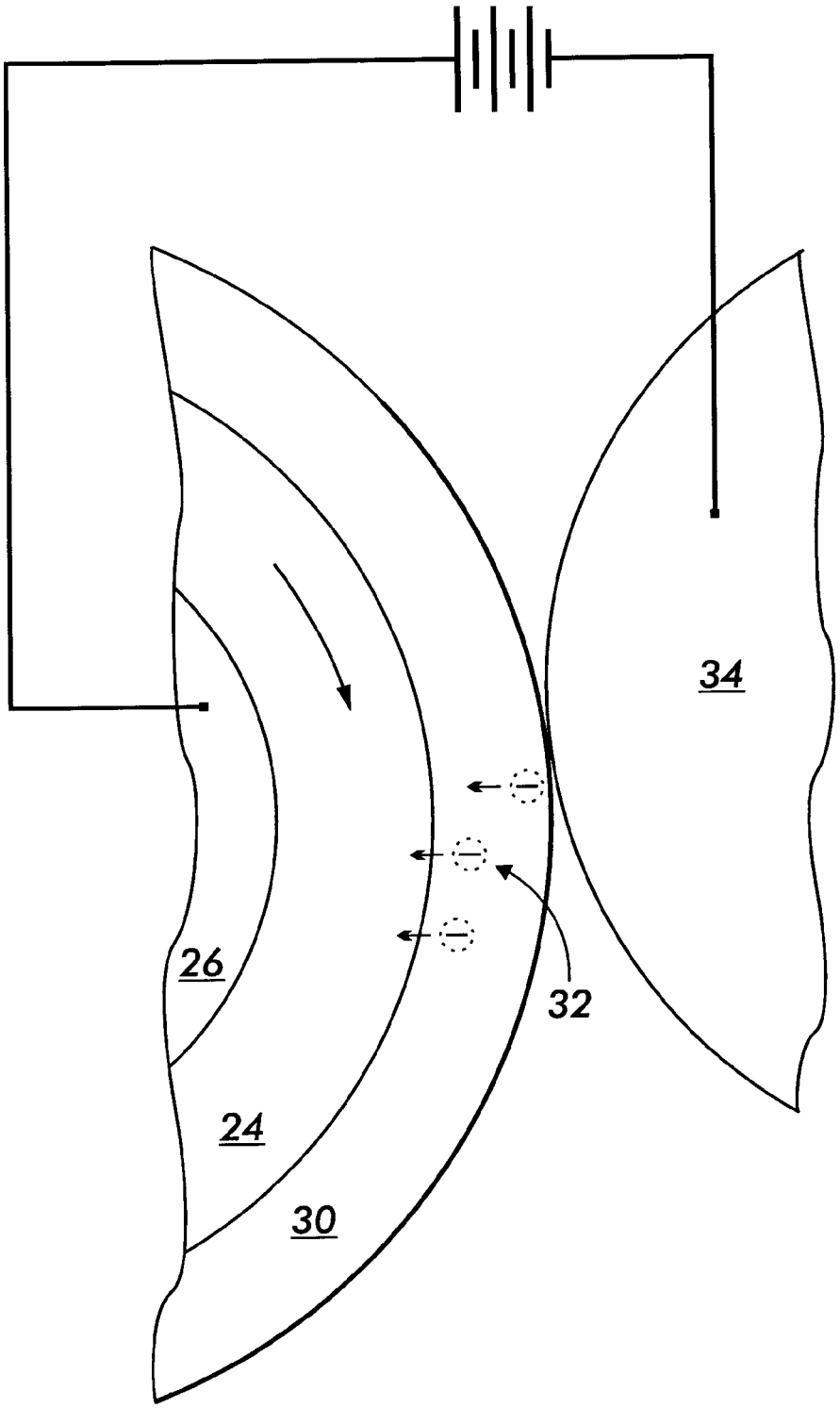
FIG. 3 is an enlarged detailed schematic representation of the charging station of FIG. 2.

A fluid applicator 28 applies an insulating fluid 30 onto the photoreceptive member 22. The insulating fluid 30 is formed of a liquid carrier and micelles 32. The insulating fluid 30 preferably has a resistivity of about $10^{13}$ ohm cm or higher. Acceptable insulating fluids include hydrocarbons, for example isopar "L", and silicones. A bias roller 34 rotates counter to the direction of rotation of the photoreceptive member 22 to evenly distribute the insulating fluid 30 over the surface of the photoreceptor layer 24. The bias roller 34 is further electrically biased to cause the deposition of negative micelles 32 on the interface of the photoreceptive member 22 and the insulating fluid 30. The micelles 32 produce a relatively large electric field across the thin photoreceptor layer 24 (see FIG. 3).

Figure 4:
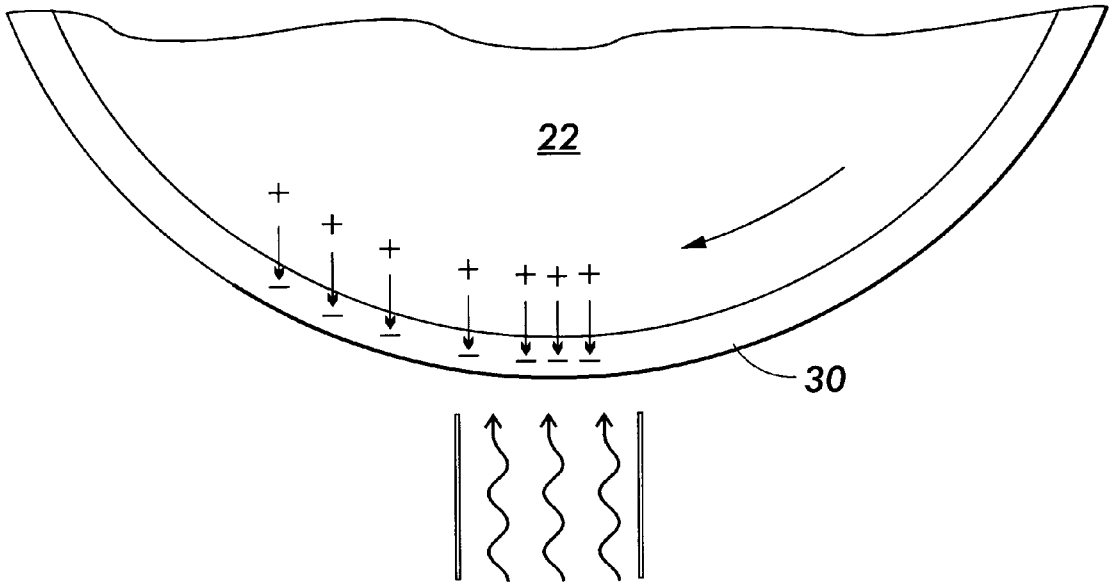
FIG. 4 is an enlarged detailed schematic representation of the exposure station of FIG. 2.

The photoreceptive member 22 rotates to move the insulating fluid 30, having the micelles at the boundary of the photoreceptor layer 24 to an exposure station 36. The exposure station 36 exposes the photoreceptor layer 24 to a light image representation of a document. The exposure station 36 preferably employs laser raster output scanner (ROS) or LED arrays to project the light image onto the photoreceptive member 22. The exposure of the photoreceptor layer 24 results in migration of charge carriers from the photoreceptor layer into the photoconductor/liquid interface whereby the micelles 32 in the exposed area of the photoreceptor layer 24 are neutralized (see FIG. 4). Thereby selective neutralization of the micelles 32 forms an electrostatic latent image defined by the micelles 32.

The photoreceptor layer 24 injects positive charge into the insulating fluid 30. Alternately, the micelles can be positively charged and the injected charges have a negative polarity. Injection of charge into an insulating fluid is known and described in "Transient Photostimulated Charge Transfer from a Photoconductor to an Insulating Fluid"; Hartman et al., Journal of Applied Physics, Vol. 46, No. 1, January 1975. The non-neutralized micelles 32 in the unexposed areas are the background part of the electrostatic latent image on the photoreceptive member 22.

The electrostatic latent image can be dried to remove excess carrier fluid and directly developed to form a toner image. However, the electrostatic latent image on the photoreceptive member 22 has relatively low electrical potential contrast. Therefore, in some circumstances, the electrostatic latent image would be difficult to develop completely. Therefore, it is preferable to transfer the electrostatic latent image from the photoreceptive member 22 to the dielectric belt 12. Because of its greater dielectric thickness relative to the photoreceptive member 22, the dielectric belt 12 enhances the electrical potential contrast between the discharged and undischarged areas.

Figure 5:
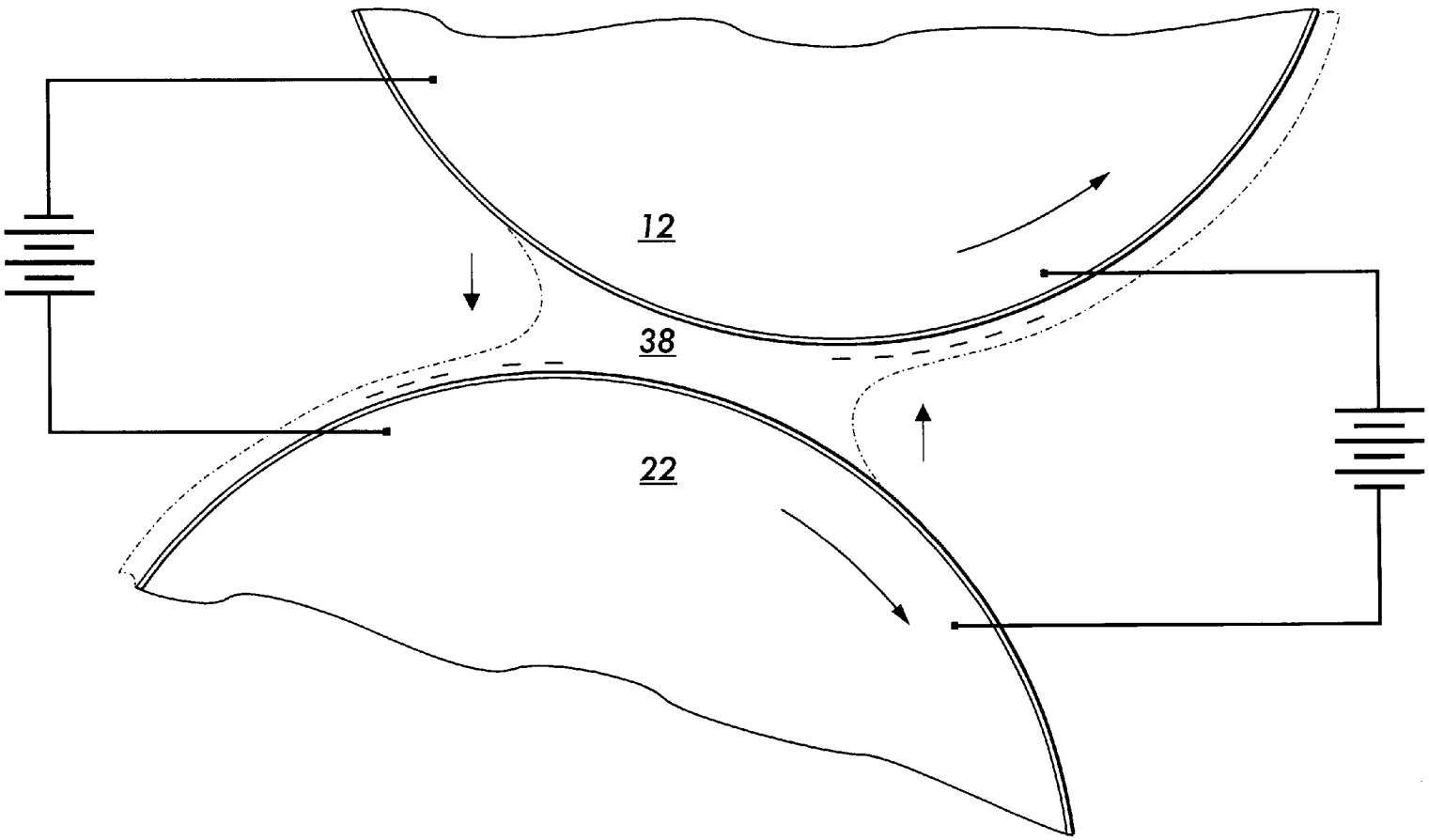
FIG. 5 is an enlarged detailed schematic representation of the transfer nip of FIG. 1.

In order to optimize the transfer of the latent image, a process known as "push-pull transfer" is used. The photoreceptive member 22 and dielectric belt 12 define a transfer nip 38 for the electrostatic latent image (see FIG. 5). The dielectric belt 12, and the photoreceptive member 22, rotate to have the same surface speed at the transfer nip 38. The transfer nip 38 has a nip entrance area and a nip exit area. At the nip entrance area, the photoreceptive member 22 and dielectric belt 12 are preferably biased to maintain the ionic micelles 32 of the electrostatic latent image on the surface of the photoreceptive member 22. Maintaining the ionic micelles 32 on the photoreceptive member prevents unintended movement or smearing of the electrostatic latent image at the nip entrance area. Before the exit, the dielectric belt 12 and photoreceptive member 22 are preferably oppositely biased relative to the entrance to transfer the ionic micelles 32 from the surface of the photoreceptive member 22 onto the dielectric belt 12. By means of this "push-pull" process, the electrostatic latent image is thereby transferred between the opposed surfaces.

The positioning of the ionic micelles 32 on the dielectric belt 12 results in higher voltage contrast between the exposed and unexposed areas of the electrostatic latent image when the dielectric thickness of the dielectric belt is greater than the dielectric thickness of the photoreceptive member 22. In addition, the dielectric belt 12 preferably is constructed to have properties that allow for improved transfuse of a developed toner image from the dielectric belt 12 to a substrate.

The photoreceptive member 22 continues to rotate past a conductive cleaner 40. Cleaner 40 is preferably formed of a soft material, and rotates in the counterdirection to the photoreceptive member 22 to remove any residual liquid from the photoreceptive member 22. The cleaner 40 is preferably electrically biased the same as the photoreceptive member 22.

The dielectric belt 12 continues to move the image area in the process direction. A drying station 42 preferably dries the electrostatic latent image by evaporating any carrier liquid that remains over the electrostatic latent image. Drying the electrostatic image reduces unintended movement of the ionic micelles 32 that could result in smearing of the electrostatic latent image. The drying station 42 can employ an airstream, a roller or other well-known arrangements to dry the electrostatic latent image.

A development station 44 preferably performs discharge area development (DAD) of the electrostatic latent image. The development station 44 develops toner particles into the discharged areas of the electrostatic latent image. The development station 44 can employ many well-known dry powder or liquid toner processes to develop the electrostatic latent image. In the preferred form, the electrostatic latent image is developed with a liquid ink.

The dielectric belt 12 then moves the developed toner image in the process direction 18 when a liquid ink is employed by the development station 44 the developed toner image is preferably moved to an image conditioning station 46. The image conditioning station 46 removes any undesirable liquid from the toner image. The image conditioning station 46 can be of well-known constructions, including apparatus to evaporate or blot excess liquid carrier from the developed toner image. Alternatively, the image conditioning station 46 can also employ a metering roll followed by a squeegee to remove excess liquid developer.

The dielectric belt 12 then moves the developed toner image in the process direction over a heating station 48 having a heated shoe. The heating station 48 heats the toner image to prepare the toner image for transfusing the toner image to a substrate 49. In addition to the heating station 48, the first roller 14 is also heated to provide additional heating of the developed toner image for improved transfuse. The substrate 49, such as paper or other well known image receiving material, is fed into a transfuse nip defined between a transfuse roller 50 and the dielectric belt 12. Through a combination of heat and pressure, the developed toner image generally is simultaneously transferred to the substrate 49 and fused thereto to form a final document.

The dielectric belt 12 continues in the process direction. The image area on the dielectric belt 12 is subsequently moved past an electrostatic eraser 52 to remove any residual charge left on the dielectric belt 12. The image area further continues in the process direction, past a cleaning station 54, for removal of residual toner. The cleaning station 54 preferably has multiple sticky rollers 55 to remove any residual toner from the dielectric belt 12. Finally, the image area moves past a cooling station 56, having a cooling shoe, to reduce the temperature of the image area on the dielectric belt 12. Reducing the temperature of the dielectric belt 12 improves transfer of the electrostatic images from the image station 20 to the dielectric belt 12. Furthermore, the reduction in temperature reduces the potential for damage to the photoreceptor layer 24 on the photoreceptive member 22 by the dielectric belt 12.

While the invention has been described with reference to the structure that has been disclosed, it is not confined to the details set forth, but intended to cover such modifications or changes as may come within the scope of the following claims. The invention is further described with discharge area development and negatively charged toner; one of skill in the art readily recognizes the applicability of other well-known developers charge arrangements and photoreceptor layers of an electrophotographic machine. While preferred embodiments of the foregoing invention have been set forth for purposes of illustration, the foregoing description should not be deemed to limit the invention herein. Accordingly, various modifications, adaptations, and alternatives may occur to one of ordinary skill in the art without departing from the spirit and scope of the present invention.

What is claimed is:

1. An electrostatographic printing machine comprising:

a photoconductor;

an insulating fluid having charged micelles, said insulating fluid forming a layer on said photoconductor; said insulating fluid and said photoconductor defining a fluid photoconductor surface interface;

a field applicator to move said charged micelles thereby generating a very high field with said photoconductor to said fluid photoconductor interface; an exposure station having a light source to expose said photoconductor in an imagewise fashion; said exposed photoconductor injecting charge carriers into said insulating fluid to neutralize said micelles in an imagewise fashion to form an electrostatic latent image; and a developing station to develop said electrostatic latent image.

2. The electrostatographic printing machine of claim 1 further comprising a fluid applicator for applying said insulating fluid to said photoconductor.

3. The electrostatographic printing machine of claim 1 wherein said micelles are negatively charged.

4. The electrostatographic printing machine of claim 1 further comprising an image bearing member; said image bearing member defining a transfer nip with said photoconductor, a voltage source to bias said image bearing member and said photoconductor to transfer said electrostatic latent image from said photoconductor to said image bearing member, said developing station developing said electrostatic latent image on said image bearing member to form a developed toner image and a transfer station comprising said image bearing member.

5. The electrostatographic printing machine of claim 4 wherein said photoconductor has a dielectric thickness and said image bearing member has a dielectric surface whose dielectric thickness is greater than said dielectric thickness of said photoconductor.

6. The electrostatographic printing machine of claim 5 wherein said transfer station further comprises a transfuse roller in said transfer station for simultaneously transferring and fusing said developed toner image to a substrate to form a final document.

7. The electrostatographic printing machine of claim 6 further comprising a heating station to heat said dielectric surface to enhance transfer of said developed toner image to said substrate.

8. The electrostatographic printing machine of claim 1 wherein said photoconductor has a thickness of about 1–2 microns.

9. The electrostatographic printing machine of claim 8 wherein said photoconductor is selected from the group consisting of selenium and phthalocyanine.

10. A method for forming an electrostatic latent image comprising:

applying an insulating fluid, having charged micelles, to the surface of a photoconductor to form a fluid photoconductor surface interface;

the photoconductor and insulating fluid brought into engagement with a counter electrode;

applying an electric field to bias said charged micelles to the fluid photoconductor surface interface;

exposing said photoconductor in an imagewise fashion to selectively inject charge carriers into the insulating fluid to neutralize charged micelles; and forming an electrostatic latent image.

11. The method of claim 10 further comprising developing said electrostatic latent image to form a developed toner image and transferring said developed toner image to a substrate to form a final document.

12. The method of claim 10 wherein said micelles are negatively charged.

13. The method of claim 10 further comprising transferring said electrostatic latent image to a dielectric surface and developing said electrostatic latent image to form a developed toner image.

14. The method of claim 13 further comprising conditioning said electrostatic latent image to remove excess liquid.

15. The method of claim 13 further comprising transferring said developed toner image to a substrate to form a final document.

16. The method of claim 15 wherein said transferring of said developed toner image to a substrate further comprises generally simultaneously fusing said developed toner image to said substrate.

17. The method of claim 13 wherein said transferring said electrostatic latent image from said photoconductor to said dielectric surface comprises applying a first biasing voltage to maintain said electrostatic latent image on said photoconductor and later applying a second voltage opposite in polarity to said first voltage to transfer said electrostatic latent image from said photoconductor to said dielectric surface.

* * * * *